US006143995A

United States Patent [19]

Ward

[11] Patent Number: 6,143,995

[45] Date of Patent: Nov. 7, 2000

[54] NOISE SUPPRESSION STANDBY SWITCH FOR A MUSICAL INSTRUMENT CABLE

[75] Inventor: Stephen R. Ward, West Jordan, Utah

[73] Assignee: Award, L.C., Murray, Utah

[21] Appl. No.: 09/152,237

[22] Filed: Sep. 11, 1998

[51] Int. Cl.[7] ..... H01H 9/00

[52] U.S. Cl. ..... 200/51.05; 200/51.1; 439/188

[58] Field of Search ..... 200/1 R, 1 A, 200/1 B, 51.05, 51.06, 51.11, 51.1; 381/118, 120, 123; 439/188, 502, 505, 507, 510–513, 578, 579, 580

[56] References Cited

U.S. PATENT DOCUMENTS

| | | | |
|---|---|---|---|
| 3,987,263 | 10/1976 | Ogasawara | 200/153 S |
| 4,431,925 | 2/1984 | Frisbee et al. | 307/10 R |
| 4,507,627 | 3/1985 | Ito et al. | 333/105 |
| 5,466,167 | 11/1995 | Scherer | 439/188 |
| 5,722,535 | 3/1998 | Nakajima | 200/504 |
| 5,818,000 | 10/1998 | Ma et al. | 200/51.03 |

*Primary Examiner*—Michael A. Friedhofer
*Attorney, Agent, or Firm*—L. Ronald Jorgensen

[57] ABSTRACT

A noise suppression standby switch for an instrument cable that connects a musical instrument, such as an electric guitar, to an amplifier system. Also, a method to suppress noise while changing a musical instrument that is connected to the amplifier system. The instrument cable has a ground conductor to ground the musical instrument through the amplifier system and a signal wire to carry an electrical signal from the musical instrument to the amplifier system. The method includes electrically disconnecting the signal wire from the musical instrument, and electrically connecting the signal wire or the input of the amplifier system to ground. The invention includes a switch, such as a double-pole single-throw switch, for disconnecting the signal wire from the musical instrument or from the amplifier system; and connecting the signal wire or the input of the amplifier system to ground. The switch is accessible to a person handling the musical instrument, so that the person handling the musical instrument may choose when to engage and disengage the amplifier system from the musical instrument. The switch may include a resister connected between the switch and ground so that when the signal wire or amplifier input is grounded, the signal will pass through the resister to ground.

13 Claims, 3 Drawing Sheets

NOISE SUPPRESSION STANDBY SWITCH FOR A MUSICAL INSTRUMENT CABLE

BACKGROUND OF THE INVENTION

1. Field of the Invention

This invention relates to a noise suppression standby switch for a instrument cable that connects a musical instrument, such as an electric guitar, to an amplifier system. This invention also include a method to suppress noise while changing a musical instrument that is connected to an amplifier system.

2. State of the Art

Often, a musician, using electrical guitars and other musical instruments connected to an amplifier system, will switch instruments during a live performance. At a typical rock concert, for example, a musician may change guitars four or five times in an hour. The musician, or a member of the stage crew, changes the guitar by removing the guitar from the instrument cable and replacing it with another guitar.

However, while the guitars are being changed, the amplifier system often produces undesirable and jarring electrical noises, sometimes called snapple or pop. There several sources of such noise. The first is from the guitar itself. A guitar is designed to produce sound. Noise is produced when the musician or member of the stage crew handles the guitar. Another source of noise is caused by electrical spikes produced as the guitar is detached or attached to the instrument cable. A final source of noise is the instrument cable itself. The detached instrument cable acts as an antenna, picking up signals from the electromagnetic fields produced by the surrounding electrical instruments and amplifying systems. Although these signals are small, the sensitive amplifying system magnifies such small signals into loud noises.

To avoid noise, the musician could turn off the amplifying system while changing the guitar. However, this is impractical. Many musicians prefer amplifiers and preamplifiers with vacuum tubes rather than with solid state components. These musicians believe that vacuum tubes amplifiers produce a more desirable sound. However, a vacuum tube needs time to build up a charge after it is turned on. Therefore, if a vacuum tube amplifier is turned off, the musician must wait a few minutes to recharge the amplifier. As a result, amplifier systems are left continually on during a performance.

SUMMARY OF THE INVENTION

It is an object of the invention to provide a method to suppress noise from an electrical musical instrument and from an instrument cable that are attached to an amplifier system.

It is also an object of the invention to provide a standby switch easily accessible to a musician when changing an electric musical instrument attached to an amplifier system.

It is an additional object of the invention to provide a standby switch that a musician can manually control when changing an electric musical instrument attached to an amplifier system.

It is a further object of the invention to provide a switch to suppress noise in the amplifier system itself.

It is another object of the invention to provide a standby switch to eliminate undesirable pop when changing musical instruments attached to an amplifier system.

The above and other objects of the invention are realized through methods for reducing electrical noise in an instrument cable. An instrument cable has a ground conductor to ground the musical instrument through the amplifier system and a signal wire to carry an electrical signal from the musical instrument to the amplifier system. The signal wire is connected to the amplifier system through a signal connector. One method comprises electrically disconnecting the signal wire from the musical instrument, and electrically connecting the signal wire to the ground conductor to ground. Another method comprises electrically disconnecting the signal wire from the amplifier system, and electrically connecting the signal connector to ground.

The invention includes a switch comprising disconnect means for electrically disconnecting the signal wire from the musical instrument, and grounding means for electrically connecting the signal wire or the signal connector to the ground conductor. The switch may be a double-pole single-throw switch. The switch may include a resister between the switch and ground. When the signal wire or signal connecter are grounded, the signal will pass through the resister to ground. The musician has access to the switch so that the musician may control when the instrument is connected to the amplifier system.

BRIEF DESCRIPTION OF THE DRAWINGS

The above and other objects, features and advantages of the invention will become apparent from a consideration of the following detailed description presented in connection with the accompanying drawings.

DETAILED DESCRIPTION

Figure 1:
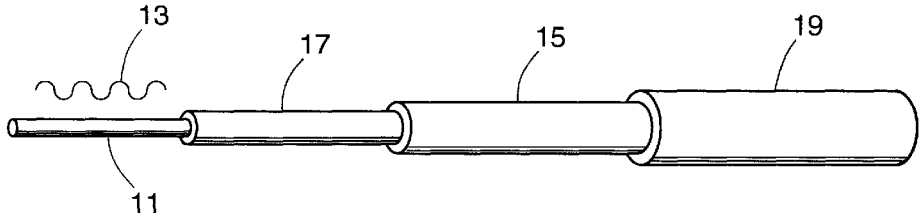
FIG. 1 shows a cut away portion of a standard instrument cable.

As shown in FIG. 1, an instrument cable is a standard coaxial cable with a center conductor signal wire 11 carrying an electrical signal 13, surrounded by an grounded outer conductor 15 that shields the center conductor from electrical interference. The two conductors are separated and spaced by a insulating dielectric 17. An outer insulating dielectric 19 covers the grounded outer conductor. In instrument cables, the insulating dielectric is usually made of rubber or plastic for ease of use.

Figure 2:
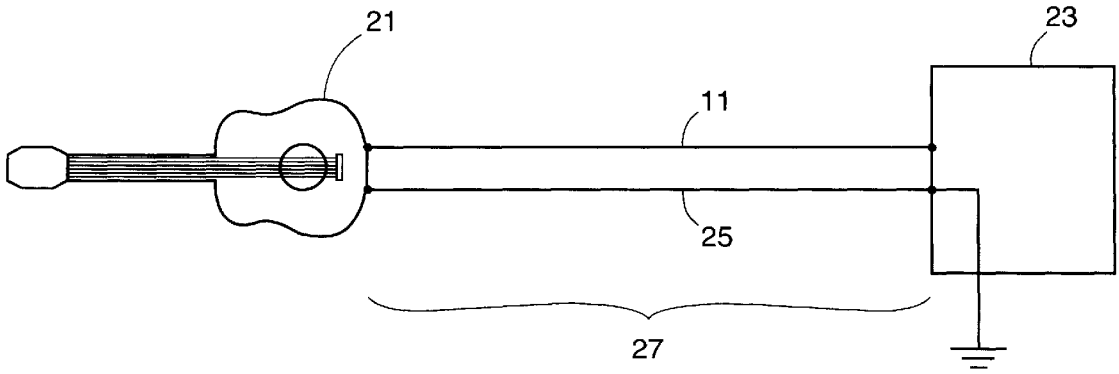
FIG. 2 is a simplified circuit diagram showing the normal operation of the instrument cable.

As shown in FIG. 2, the instrument cable 27 connects a musical instrument 21 to an amplifying system 23. The signal wire 11 carries the electrical signal from the musical instrument to the amplifying system. A ground conductor 25 grounds the musical instrument through the amplifier system. Although the signal wire and ground conductor are shown in FIG. 2 as a separate lines, in actuality the ground conductor is the outer ground conductor 15 that surrounds and shields the signal wire as shown in FIG. 1.

Figure 3A:
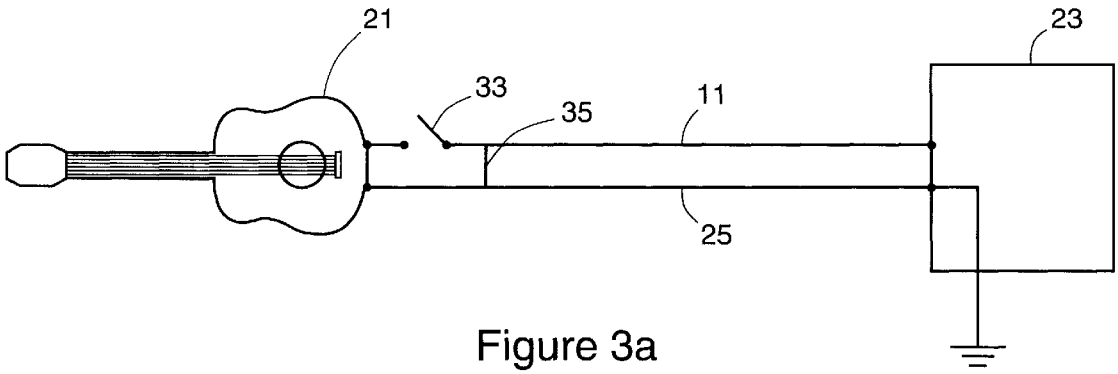
FIG. 3*a* is a simplified circuit diagram showing a method of suppressing noise in the instrument cable.
Figure 3B:
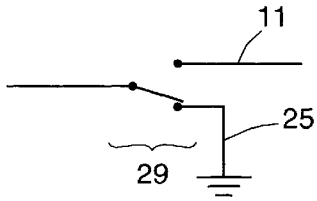
FIG. 3*b* is schematic of a double-pole single-throw switch.

FIG. 3*a* shows a method for eliminating electrical noise on the instrument cable. The signal wire 11 is opened 33. That is, the signal wire is electrically disconnected from the musical instrument. Thus, the amplifier 23 is electrically isolated from the musical instrument and is protected from noise produced by the musical instrument. The signal wire is electrically connected 35 to the ground conductor 25, grounding the signal wire. This keeps the detached signal wire and amplifier input from acting as an antenna, picking up stray signals from the electro-magnetic fields produced by surrounding electrical instruments and amplifying systems. These stray signals are grounded. As shown in FIG. 3*b*, the signal wire 11 can be disconnected from the musical instrument and grounded by a double-pole single-throw switch 29.

The signal wire is opened and grounded near the musical instrument. This is the most convenient location for a person changing the musical instrument to open and ground the musical instrument. However, as shown below in FIG. 8, the signal wire may be opened near the amplifier.

Figure 4:
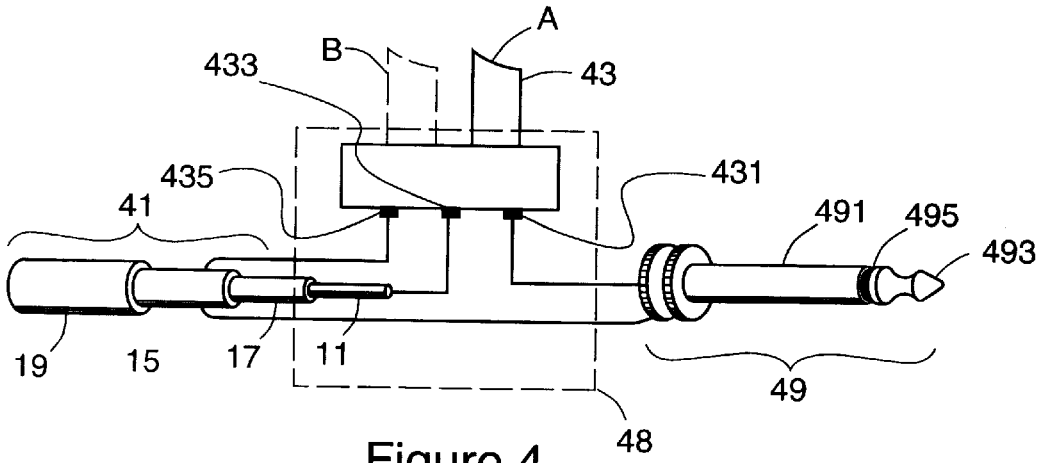
FIG. 4 shows a double-pole single-throw switch connected to an instrument cable.

FIG. 4 shows a double-pole single-throw switch 43 connected between the instrument cable 41 and a male connector plug 49. When the male connector plug is inserted into a female receptor in a musical instrument, a plug tip 493 connects into the musical instrument so as to receive an electrical signal from the musical instrument. The plug sleeve 491 grounds the musical instrument by connecting with the grounded outer conductor 15 of the instrument cable. An insulating dielectric 495 separates the plug tip from the plug sleeve.

The first terminal 431 connects to the plug tip 493. The second terminal 433 connects to the signal wire 11 of the instrument cable. The third terminal 435 of the double-pole single-throw switch connects to the grounded outer conductor 15 of the instrument cable. Although the terminals are shown as permanently connected to the instrument cable, in a variation of the invention, the double-pole single-throw switch is separate from the instrument cable and the second and third terminals are adapted to connect into a standard instrument cable. An shielded metal body 48 covers the switch.

When the person changing the instruments moves the double-pole single-throw switch 43 to the "A" position, the plug tip 493 electrically connects to the signal wire 11 of the instrument cable. Thus, a signal travels from the plug tip through the signal wire to the amplifying system. When the person moves the switch to the "B" position, the signal wire connects to the grounded outer conductor 15 and is disconnected from the plug tip. Thus, no signal is carried from the musical instrument and any signals in the signal wire and in the amplifier input are grounded. The double-pole single-throw switch is designed so that the first and second terminal and the second and third terminal are inversely dependant. When the first and second terminal are connected, the second and third terminals are disconnected. When the first and second terminal are disconnected, the first and second terminals are connected. The double-pole single-throw switch allows the person changing the instrument to control when the instrument is connected to the amplifying system.

Figure 5:
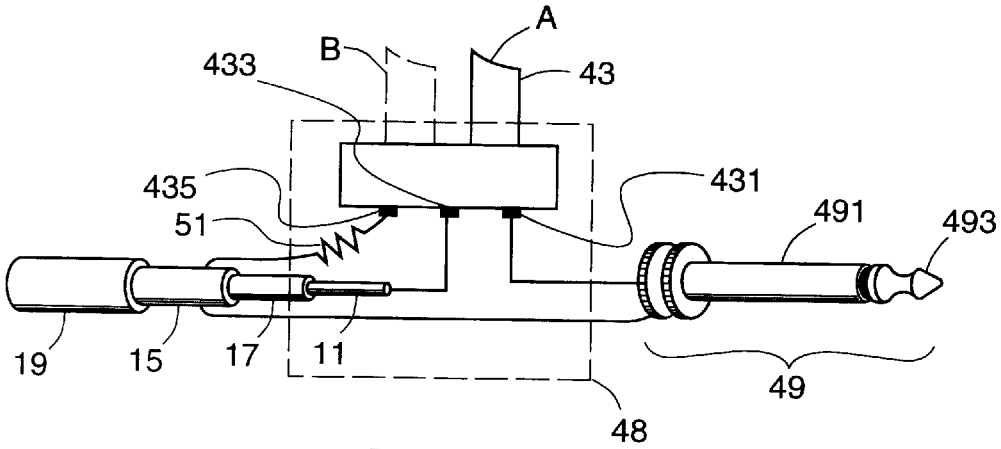
FIG. 5 shows a double-pole single-throw switch with resister connected to an instrument cable.

FIG. 5 is almost identical to FIG. 4, except a resister 51 is between the third terminal 435 and the grounded outer conductor 15. When the third terminal and grounded outer conductor are connected and a signal is received in the third terminal, the signal will pass from the third terminal, through the resister, to the ground conductor. If there is not a DC path to ground at the input of the amplifier and if there is any leakage in the coupling capacitors, there could be a charge or voltage stored in the cable. This stored charge would be discharged when the switch is turned to the ground, causing a popping noise in the system. Most amplifiers already have a resister at the input, but if the amplifier did not have a resister, the resister 51 shown in FIG. 5 would prevent this popping noise.

Figure 6:
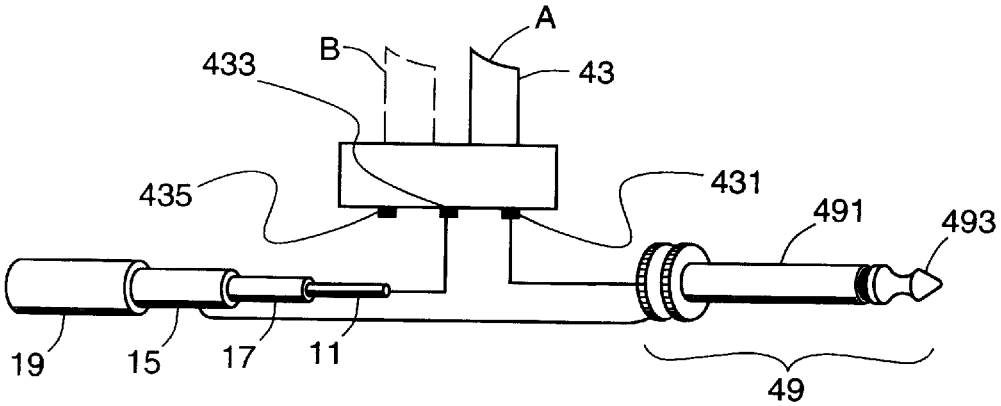
FIG. 6 shows another switch connected to an instrument cable.

FIG. 6 is almost identical to FIG. 4, except that there is no connection between the first terminal 435 and the grounded outer conductor 15. This is the least desirable configuration. When the switch is in position "B" the signal path is opened, as in FIG. 4, but the signal wire is not grounded. Thus, the signal wire may act as an antenna, picking up electromagnetic noise and transmitting it to the amplifier system.

Figure 7:
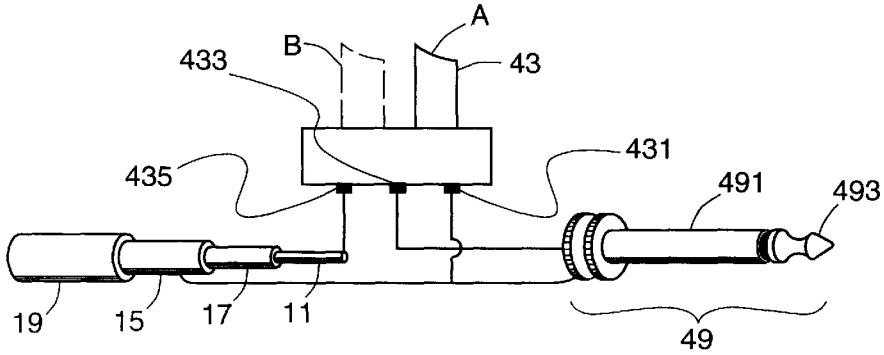
FIG. 7 shows another embodiment of the double-pole single-throw switch connected to an instrument cable.

In FIG. 7, the first terminal 433 connects to the plug tip 493. The second terminal 435 connects to the signal wire 11. The third terminal 431 connects to the outer conductor 15. As with the switch shown in FIG. 4, the terminals may be adapted to connect to a standard instrument cable rather than being permanently attached. When the double-pole single-throw switch 43 is in the "B" position, the plug tip 493 connects to the signal wire 11 and a signal from the musical instrument is carried to the amplifying system. When the switch is in the "A" position, the plug tip is connected to the grounded outer conductor 15 and disconnected from the signal wire. Thus, no signal is carried from the musical instrument and the signal wire.

Figure 8:
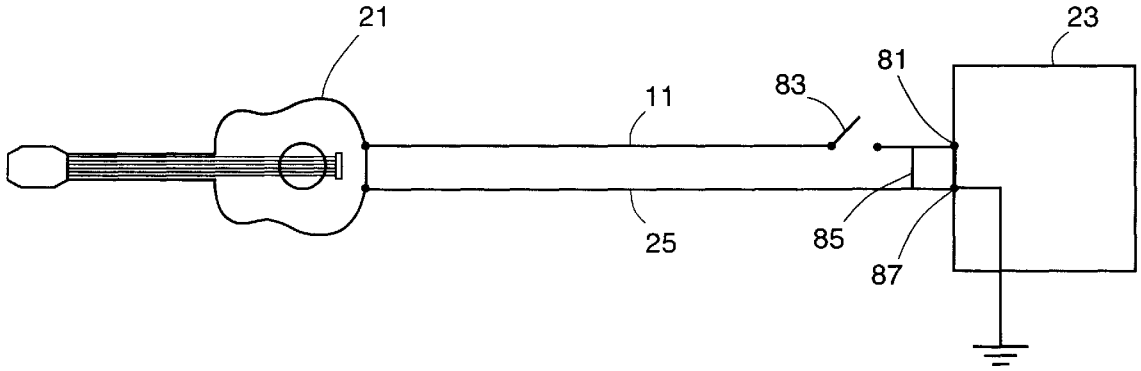
FIG. 8 is a simplified circuit diagram showing a method of suppressing noise in the amplifier system.

Since the signal wire in the instrument cable is ungrounded, the configuration shown in FIG. 7 is used as shown in FIG. 8. FIG. 8 shows a method for eliminating electrical noise, not in the instrument cable, but in input connector 81, 87, of the amplifier system itself. The instrument cable connects the musical instrument 21 to the amplifier system 23. The signal wire 11 carries signals from the musical instrument to the amplifier system. The amplifier system receives signals from signal wire through a signal connector 81. The signal connector may be part of a plug like the plug tip 493 of the male connector plug 49 shown in FIG. 7. A ground connector 87 grounds the ground conductor 25 through the amplifier system. The ground connector may be part of a plug like the plug sleeve 491 shown in FIG. 7.

When the signal wire is opened 83, the amplifier is electrically isolated from the musical instrument 21 and from the signal wire 11. Thus, the amplifier is electrically isolated from any noise in the musical instrument or in the signal wire. The signal connector 81 is connected 85 to the ground connector 87. This grounds any noise generated in the signal connector or in the amplifier system. This method eliminates noise, but requires that a switch be near the amplifier rather than near the musical instrument. This generally is not as desirable as having the switch near the instrument as shown in FIG. 3 and FIG. 4.

The above-described arrangements are only illustrative of the application of the principles of the present invention. Numerous modifications and alternative arrangements may be devised by those skilled in the art without departing from the spirit and scope of the present invention. The appended claims are intended to cover such modifications and arrangements.

I claim:

1. A switch for an instrument cable to connect a musical instrument to an amplifier system, the instrument cable having a ground conductor to ground the musical instrument through the amplifier system and a signal wire to carry an electrical signal from the musical instrument to the amplifier system, the switch comprising:

disconnect means for electrically disconnecting the signal wire from the musical instrument; and grounding means for electrically connecting the signal wire to the ground conductor; wherein the switch is accessible to a person handling the musical instrument, so that the person handling the musical instrument may choose when to engage and disengage said disconnect means and said grounding means without physically disconnecting the instrument cable from the musical instrument or from the amplifier system.

2. The switch of claim 1 wherein the switch is a double-pole single-throw switch.

3. The switch of claim 1 wherein:

said disconnect means further comprises connector means to receive an electrical signal from the musical instrument, a first terminal electrically connected to the connector means, a second terminal electrically connected to the signal wire, and means to connect and disconnect the first and second terminal so that when the first terminal is connected to the second terminal, an electrical signal from the musical instrument will pass through the connector means through the first terminal and second terminal into the signal wire, and when the first terminal is disconnected from the second terminal no signal will pass from the musical instrument into the signal wire; and said grounding means further comprises a third terminal electrically connected to the ground conductor, and means to connect and disconnect the second and third terminal so that when the second terminal is connected to the third terminal, an electrical signal from the signal wire will pass through the second and third terminal to ground through the ground conductor, and when the second terminal is disconnected from the third terminal, no signal will pass from the signal conductor to the ground conductor;

said means to connect and disconnect the first and second terminal and said means to connect and disconnect the second and third terminal being inversely dependant so that when the first and second terminal are connected, the second and third terminals are disconnected, and when the first and second terminal are disconnected, the first and second terminals are connected.

4. The switch of claim 3 wherein the connector means is permanently attached to the musical instrument.

5. The switch of claim 3 wherein the second terminal is permanently attached to the signal wire and the third terminal is permanently attached to the ground conductor.

6. The switch of claim 3 further comprising:

a resister connected between the third terminal and the ground conductor so that when the third terminal and the ground conductor are connected and a signal is received in the third terminal, the signal will pass from the third terminal, through the resister, to the ground conductor.

7. The switch of claim 3 wherein the musical instrument includes a female receptor and said connector means is a male plug that may be inserted into a female receptor, the male plug comprising:

a plug tip to receive an electrical signal from the musical instrument, and a plug sleeve to ground the musical instrument by connecting the instrument with the grounded conductor of the instrument cable.

8. A switch for an instrument cable to connect a musical instrument to an amplifier system, the instrument cable having a ground conductor to ground the musical instrument though the amplifier system and a signal wire to carry an electrical signal from the musical instrument to the input of the amplifier system, the signal wire being electrically connected to the amplifier system through a signal connector, the switch comprising:

disconnect means for electrically disconnecting the signal wire from the amplifier system;

grounding means for electrically connecting the signal connector to the ground conductor;

wherein the switch is accessible to a person handling the musical instrument, so that the person handling the musical instrument may choose when to engage and disengage said disconnect means and said grounding means, without physically disconnecting the instrument cable from the musical instrument or the amplifier system.

9. The switch of claim 8 wherein:

the disconnect means further comprises:

a first terminal electrically connected to the signal connector, a second terminal connected to the signal wire, so as to receive an electrical signal from the signal wire, and means to connect and disconnect the first and second terminal so that when the first terminal is connected to the second terminal, an electrical signal from the signal wire will pass through the first terminal and second terminal through the signal connector into the amplifier system, and when the first terminal is disconnected from the second terminal no signal will pass from the signal wire into the amplifier system; and the grounding means further comprises:

a third terminal electrically connected to the ground conductor, and means to connect and disconnect the first and third terminal so that when the first terminal is connected to the third terminal, an electrical signal from the signal connector will pass through the first and third terminal to ground through the ground conductor, and when the first terminal is disconnected from the third terminal, no signal will pass from the signal connector to the ground conductor, said means to connect and disconnect the first and second terminal and said means to connect and disconnect the second and third terminal being inversely dependant so that when the first and second terminal are connected the second and third terminals are disconnected and when the first and second terminal are disconnected, the first and second terminals are connected.

10. The switch of claim 9 wherein the signal connector is permanently attached to the amplifier.

11. The switch of claim 9 wherein the second terminal is permanently attached to the signal wire and the third terminal is permanently attached to the ground conductor.

12. The switch of claim 9 further comprising:

a resister connected between the third terminal and the ground conductor so that when the third terminal and the ground conductor are connected and a signal is received in the third terminal, the signal will pass from the third terminal, through the resister, to the ground conductor.

13. The switch of claim 9 further wherein the amplifier system includes a female receptor and the signal connector is a male connector plug that may be inserted into a female receptor, comprising:

a plug tip to pass an electrical signal into the amplifier system, and a plug sleeve to ground the ground conductor of the instrument cable.

* * * * *